US008567164B2

(12) United States Patent
Thomasset et al.

(10) Patent No.: US 8,567,164 B2
(45) Date of Patent: Oct. 29, 2013

(54) PLASTIC BOTTLE FOR HOT FILLING OR HEAT TREATMENT

(75) Inventors: Jacques Thomasset, Vouvry (CH); Joachim Pellissier, Vouvry (CH); Stéphane Mathieu, Vouvry (CH)

(73) Assignee: Aisapack Holding S.A., Vouvry (CH)

( * ) Notice: Subject to any disclaimer, the term of this patent is extended or adjusted under 35 U.S.C. 154(b) by 367 days.

(21) Appl. No.: 12/667,996

(22) PCT Filed: Jun. 27, 2008

(86) PCT No.: PCT/IB2008/052599

§ 371 (c)(1),
(2), (4) Date: Feb. 22, 2010

(87) PCT Pub. No.: WO2009/007869

PCT Pub. Date: Jan. 15, 2009

(65) Prior Publication Data

US 2010/0186352 A1 Jul. 29, 2010

(30) Foreign Application Priority Data

Jul. 11, 2007 (EP) ..... 07112225

(51) Int. Cl.
*B65B 55/14* (2006.01)

(52) U.S. Cl.
USPC ..... 53/440; 53/467; 53/127; 426/401

(58) Field of Classification Search
USPC ..... 53/440, 467, 473, 127; 422/302; 426/401
See application file for complete search history.

(56) References Cited

U.S. PATENT DOCUMENTS

| | | | | |
|---|---|---|---|---|
| 4,993,566 | A | 2/1991 | Eberle | |
| 7,367,365 | B2 * | 5/2008 | Slat et al. | 141/8 |
| 7,727,630 | B2 * | 6/2010 | Kodas et al. | 428/403 |
| 7,900,425 | B2 * | 3/2011 | Bysick et al. | 53/440 |
| 2005/0142309 | A1 * | 6/2005 | Goto et al. | 428/34.6 |
| 2005/0262813 | A1 | 12/2005 | Michalsky | |
| 2006/0255005 | A1 * | 11/2006 | Melrose et al. | 215/381 |
| 2007/0045221 | A1 * | 3/2007 | Trude et al. | 215/379 |
| 2007/0125742 | A1 * | 6/2007 | Simpson et al. | 215/376 |
| 2007/0212539 | A1 * | 9/2007 | Yamada et al. | 428/383 |

FOREIGN PATENT DOCUMENTS

| | | |
|---|---|---|
| DE | 195 02 449 | 8/1996 |
| EP | 1 714 631 | 10/2006 |
| JP | 2003-095240 | 4/2003 |

(Continued)

OTHER PUBLICATIONS

English Translation of Written Opinion (IPRP Chapter I) for PCT/IB2008/052599, mailed Feb. 16, 2010.

(Continued)

*Primary Examiner* — Hemant M Desai
(74) *Attorney, Agent, or Firm* — Nixon & Vanderhye P.C.

(57) ABSTRACT

Process of hot-filling a plastic container comprising a side wall connected to a neck and to a base, with a liquid or viscous product; process consisting in at least filling the container with a product at high temperature, hermetically sealing the container, cooling the container and its contents; process characterized in that a plastic container is used for which the linear thermal expansion coefficient of the side wall is greater than 0.00014 m/(m.K) and in that the container is allowed to expand and shrink at least as much as its contents.

9 Claims, 2 Drawing Sheets

(56) References Cited

FOREIGN PATENT DOCUMENTS

| | | | |
|---|---|---|---|
| RU | 99128038 | | 1/2002 |
| RU | 2269458 | | 6/2005 |
| RU | 2295479 | | 8/2005 |
| SU | 1838197 | A3 | 12/1990 |
| WO | WO 98/53986 | | 12/1998 |
| WO | WO 2004/014745 | | 2/2004 |
| WO | WO 2005/070814 | | 8/2005 |
| WO | WO 2007/054449 | | 5/2007 |

OTHER PUBLICATIONS

International Search Report for PCT/IB2008/052599, mailed Dec. 22, 2008.
Written Opinion of the International Searching Authority for PCT/IB2008/052599, mailed Dec. 22, 2008.
Russian Office Action dated Jan. 12, 2012, and its English translation.
International Standard, GOST 16338-85 (only in Russian language).
Japanese Office Action dated Nov. 27, 2012 and its English translation.

* cited by examiner

PLASTIC BOTTLE FOR HOT FILLING OR HEAT TREATMENT

This application is the U.S. national phase of International Application No. PCT/IB2008/052599, filed 27 Jun. 2008, which designated the U.S, and claims priority to European Application No. 07112225.3, filed 11 Jul. 2007, the entire contents of each of which is hereby incorporated by reference.

FIELD OF THE INVENTION

The invention relates to plastic containers for liquid or viscous products. More specifically, it relates to containers, the contents of which can undergo temperature variations of several tens of degrees.

The invention relates in particular to the field of packaging by hot filling (above 70° C.) and to packaging by heat treatment (pasteurization).

PRIOR ART

Polyethylene terephthalate (PET) bottles are used in many fields owing to their excellent properties of resistance, lightness, transparency and organolepticity. These bottles are manufactured at a high production rate by biaxially stretching a preform in a mould.

However, although these bottles offer many advantages, they have the drawback of deforming when their temperature is above 60° C. Filling these bottles with a product at a high temperature (above 70° C.) causes such distortions that said bottles become unfit for use. Several processes for remedying the aforementioned drawback and allowing PET bottles to be hot-filled have been described in the prior art.

Heat-setting is considered to be the most effective process for improving the heat resistance of biaxially oriented PET bottles. The principle of this process, widely used in commercial operations, consists in subjecting the walls of the bottle to a heat treatment so as to increase the crystallization and thus improve molecular stability at high temperature. This principle may be applied in various ways by heat-setting processes and devices described in the prior art. One major advantage of heat-setting processes is that the filling processes do not have to be modified, the heat-setting of the bottle being carried out during the manufacture of said bottle.

However, the bottles that have undergone a heat treatment in order to allow filling with a liquid at high temperature have several drawbacks.

A first drawback of these bottles lies in the fact that only specific grades of polyethylene terephthalate can be used. These specific grades are more difficult to produce and increase the cost of the container.

A second drawback is linked to the reduction in bottle production rate because the heat-setting process slows down the blow-moulding cycle.

A third drawback is due to the weight of these bottles. When a bottle is filled with a hot liquid, this results, after cooling, in a negative pressure inside the bottle; said negative pressure having the effect of randomly deforming the walls of the bottle. The most widely used process for offsetting the negative pressure in the bottle is to add compensating panels which allow the bottle to deform in a controlled manner. However, bottles having compensating panels are more rigid and therefore heavier. As a result, more material than is strictly necessary for good preservation of the product is used.

Furthermore, the compensating panels detract from the appearance of the container, making it less attractive to the user.

Flexible pouches are also commonly used for packaging liquid products. These pouches are produced from thin preprinted films. These containers offer many advantages including the weight, cost and compaction before and after use.

They do however have drawbacks, in particular when their contents are subjected to high temperature variations.

Specifically, if the packaged liquid is heated, intentionally or unintentionally (such as, for example, by leaving it inside a car that is exposed to the sun), the product expands, sometimes to such an extent that the container may burst.

DEFINITION OF THE TERMS USED IN THE SUMMARY OF THE INVENTION

In the summary of the invention the following terms and abbreviations are used:

Laminate: multilayer film resulting from the lamination of several films
PET: polyethylene terephthalate
PP: polypropylene
PE: polyethylene
LDPE: low-density polyethylene
LLDPE: linear-low-density polyethylene
HDPE: high-density polyethylene
EVOH: ethylene/vinyl alcohol

GENERAL SUMMARY OF THE INVENTION

The invention makes it possible to overcome the aforementioned drawbacks due to a container, which when it is subjected to a temperature variation, expands and shrinks together with the contained product.

In the summary of the invention, the contained product denotes a liquid or viscous product which may contain solid elements. Since these products are predominantly water-based, the variation in volume of said products is around 3% when the temperature varies by 65° C., which corresponds to a volumetric expansion coefficient of around 0.00042 $m^3/(m^3.K)$ and to a linear expansion coefficient of 0.00014 m/(m.K). These values are given by way of indication, knowing that the thermal expansion of water varies with temperature.

The products may also be oil-based and their behaviour depends on the thermal properties of the oil used.

This container has many advantages when it is used for packaging a product at high temperature. Unlike PET bottles, this container does not require a heat-setting process to prevent the shrinkage of the walls under the effect of the filling temperature. Unlike PET bottles, this container does not require compensating panels to offset the variations in volume of the product during cooling.

This container is characterized by the fact that its thermal expansion is greater than or equal to the thermal expansion of the product. During filling, the temperature of the product heats the walls of the container which expand. The expanded container is then hermetically sealed. On cooling, the container shrinks and returns to its initial geometry; this results, after cooling, in a relative pressure in the container that is positive or zero. A slight pressure in the container after cooling is advantageous, as it improves the compressive strength of the container and it also makes it easier to grip the container.

The use of the container in a filling process that requires a heat treatment of the container and its contents, such as the pasteurization process for example, is also particularly advantageous. During the rise in temperature of the container and of the product, the container expands at least as much as the product, which prevents an excessive pressure rise in the container.

For the user, this container is of great interest, as it adapts to the temperature variations without its aesthetic properties being modified, and with very low pressure variations in the container.

Another advantage of the container according to the invention is that when the contained product is subjected to a temperature increase, then the container will expand together with the product and thus the walls, the base and the welds (in the case of a container produced using flexible films) of the container are not subjected to, or only very slightly, a pressure increase and therefore easily withstand it.

The invention may be used for packaging liquid or viscous products.

A wide variety of containers may be produced according to the invention. The container may be manufactured by moulding, by extrusion-blow moulding, or may be produced from films.

One particularly advantageous container is composed of a side wall formed from a film and also a base and a neck joined by welding to said film.

Most materials used to produce containers have a thermal expansion that is insufficient to offset the variations in volume of the contents of the container.

According to the invention, the expansion coefficient of the container is greater than or equal to the expansion coefficient of the contained product. The linear expansion coefficient of the walls of the container is generally greater than 0.00014 m/(m.K), and preferably greater than 0.00018 m/(m.K). A container based on low-density polyethylene is particularly advantageous.

The invention will be better understood with the aid of the description of embodiments of the latter and from the following figures in which:

FIG. 1 illustrates the container before filling.

FIG. 2 shows the thermal expansion of the container during filling with a hot product.

FIG. 3 shows the expanded container at the moment that the container is sealed in a leaktight manner.

FIG. 4 illustrates the container and its contents after cooling; the container has contracted under the effect of the drop in temperature.

FIG. 5 illustrates the container filled with a product at low temperature, and hermetically sealed.

FIG. 6 illustrates the container and its contents after heating in a hot bath for several minutes; the container expands under the effect of the temperature.

FIG. 7 illustrates the container and its contents after cooling; the container has contracted under the effect of the drop in temperature.

FIG. 8 illustrates a preferred embodiment of the invention consisting of a container formed by assembling a neck, a base, and a tubular body; said tubular body being formed from a laminate, the expansion coefficient of which is greater than 0.00014 m/(m.K).

DETAILED SUMMARY OF THE INVENTION

Several processes for packaging liquid or viscous products impose large variations in the temperature of the product during the packaging process. These temperature variations are restrictive for the container since the temperature variations lead to variations in the volume of the product and consequently pressure variations in the container.

The inventors have found a container which prevents negative relative pressure in the container after hot filling. The first embodiment of the invention is particularly advantageous since it prevents the deformation of the container during cooling. The first embodiment of the invention is illustrated by FIGS. 1 to 4.

Figure 1:
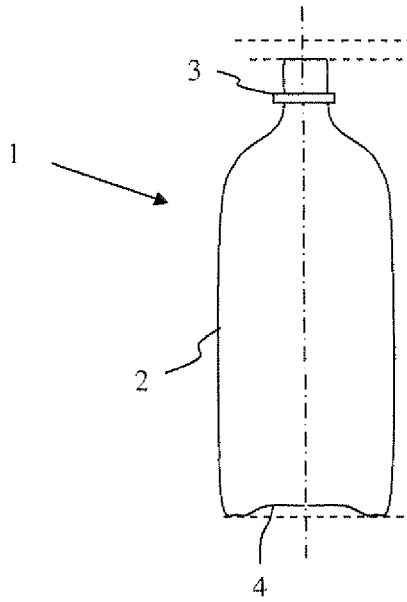
FIGS. 1 to 4 illustrate a first embodiment of the invention consisting of a hot-filling process.

FIG. 1 illustrates the layout of a container according to the invention, said container 1 comprising a side wall 2, a neck 3 and a base 4; and said container being characterized by the expansion of its side walls under the effect of temperature. The container is supplied at low temperature, said low temperature preferably being ambient temperature (20° C.). According to the filling methods known to a person skilled in the art, the container 1 may be cleaned, rinsed, dried before the filling process illustrated in FIG. 2. In order to simplify the summary of the invention, only the steps necessary for understanding the invention are explained.

Figure 2:
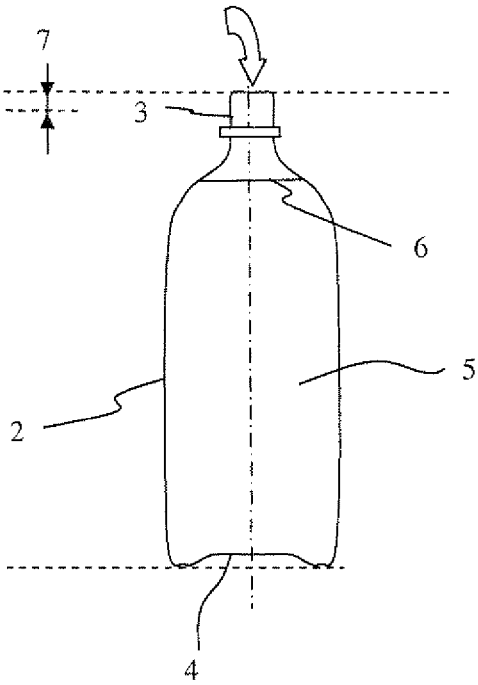
Figure 3:
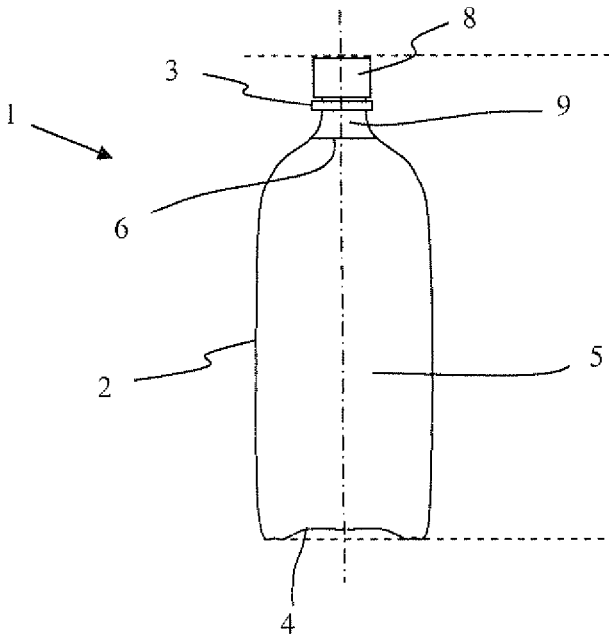

FIG. 2 represents the filling of a container 1 with a product 5 at high temperature. Usually, said high filling temperature is 85° C. Under the effect of the high temperature of the product 5 when it is poured into the container, the walls 2 of the container expand almost instantaneously. The expansion of the container occurs gradually during filling and depends on the filling level 6 which defines the limit of contact with the product 5 and the walls of the container. The expansion of the container is illustrated schematically by the height variation 7. This thermal expansion of the walls 2 is generally manifested by a variation in the height and in the diameter. After the filling process and before being hermetically sealed, this results in a container of which the volume is greater than the initial volume, FIG. 3 shows the hermetic sealing of the container after the filling process, the product 5 still being at high temperature during said sealing. A cap 8 or another known means of sealing is applied to the neck 3 and ensures hermetic sealing. Generally, a volume of gas 9 is trapped in the container at the time of sealing. This volume of gas depends on the degree of filling of the container. It is preferable to rapidly seal the container after filling in order to prevent this volume of gas being too hot at the time of sealing. The gas 9 trapped in the headspace may be air, nitrogen or any other gas or gaseous mixture known to a person skilled in the art. At the time of hermetic sealing, the container 1 and the product 5 are at high temperature. The volume of the product 5 is consequently expanded, likewise the walls of the container.

Figure 4:
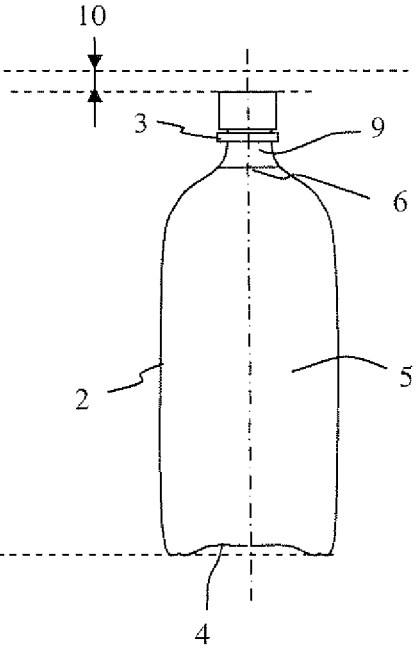

FIG. 4 illustrates the container and its contents after cooling to the storage temperature. Often the storage temperature is close to ambient temperature. Under the effect of cooling, the container and its contents are contracted. A liquid product based on water, for example, sees its volume vary by around 3% when its temperature varies between 85 and 20° C. The container according to the invention contracts under the effect of cooling; and its contraction is such that the relative pressure in the container after cooling is positive or zero; the contraction of the container is therefore greater than or equal to the contraction of the product.

Most of the materials used for producing containers have thermal expansions that are insufficient to compensate for the variation in volume of the product and of the gas volume 9. A container made of PET or of HDPE for example will be under vacuum after cooling, since the expansion coefficient of these materials is insufficient to compensate for the variations in volume of the product. Surprisingly, it has been found that the container made of LDPE has thermal expansion properties which make it possible to prevent a negative relative pressure in the container after cooling. More generally, it has been found that the linear thermal expansion coefficient of the container must be greater than 0.00014 m/(m.K) and preferably greater than 0.00018 m/(m.K). The lower the filling level of the container, the higher the expansion coefficient of the container must be.

The inventors have found that the linear expansion of the container is not necessarily equal in all directions. For example, the linear expansion of the container in height may be greater than the circumferential expansion, or vice versa. From two expansion coefficients measured along two perpendicular directions, it is possible to define an average linear expansion coefficient which gives rise to an identical variation in volume of the container. It has been found that this average linear expansion coefficient must be greater than 0.00014 m/(m.K) and preferably greater than 0.00018 m/(m.K).

The geometry of the container after cooling and shrinkage is generally identical to the geometry of the container before filling and expansion. However, a slight hysteresis is observed in certain cases, the shrinkage of the container being slightly lower than its expansion. In this case, the final volume of the container is slightly larger than the initial volume. In another case, the shrinkage of the container is slightly greater than its expansion; the final volume of the container is therefore smaller than the initial volume. As a general rule, the final geometry of the container is substantially identical to the initial geometry and the container may be expanded and shrunk several times in a reversible manner.

The cooling of the container has little influence, as the cooling may be rapid, slow, in stages or continuous. Often spraying the container with water allows a rapid and effective cooling. The various cooling methods known to a person skilled in the art may be used, only the initial and final temperatures of the container having an influence on the variation in volume of said container.

Figure 5:
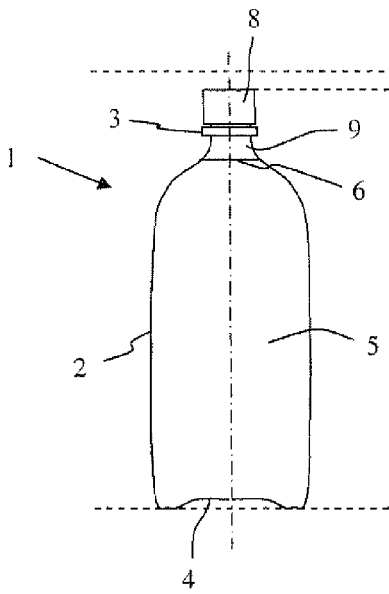
FIGS. 5 to 8 illustrate a second embodiment of the invention in which the container and its contents are heated then cooled together.
Figure 6:
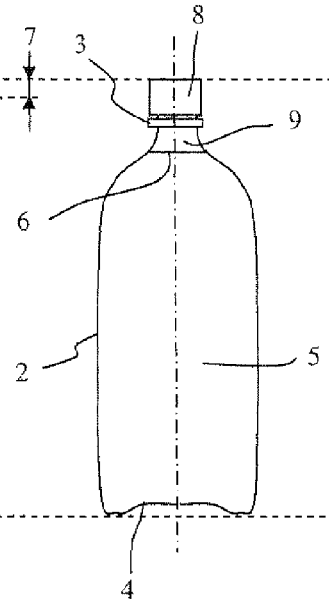
Figure 7:
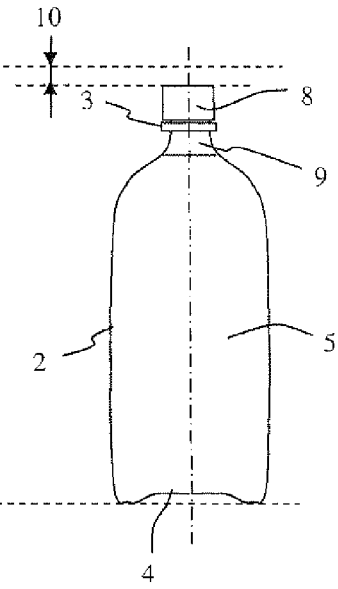

Other packaging processes consist in filling the container with a product at low temperature, then in carrying out a heat treatment on the container and its contents. The second embodiment of the invention is particularly advantageous since it prevents an excessive pressure in the container during the heat treatment. FIGS. 5 to 7 illustrate the second embodiment of the invention.

FIG. 5 illustrates the layout of a container according to the invention, said container 1 comprising a side wall 2, a neck 3 and a base 4, and said container being characterized by the expansion of its side walls under the effect of temperature. The container is filled with a liquid or viscous product 5 and sealed hermetically by a cap 8. The container and its contents are at low temperature, said low temperature preferably being ambient temperature (20° C.). Generally, a volume 9 of gas which may be air is trapped in the headspace. The degree of filling of the container is illustrated by the liquid level 6. A high degree of filling is favourable since the thermal expansion of the gases is greater than that of the liquids. It is preferable to have a degree of filling of the container 1 greater than 90%.

FIG. 6 illustrates the heat treatment step, which consists in raising the temperature of the container and its contents. One heat treatment often used consists, for example, in immersing the container and its contents in a water bath at 80° C. for 10 minutes. The heat treatment causes a gradual rise in temperature of the container and its contents, which creates the volumetric expansion of the product 5, and of the gas volume 9. The container according to the invention is characterized by a high thermal expansion of the walls 2 which makes it possible to prevent a high relative pressure in the container. The difficulty encountered with the containers according to the prior art is linked to the fact that the high pressure in the container may cause the base 4 to pop out in the opposite direction. Often a specific design of the base 4 is necessary to prevent deflection of the base. This more resistant base is heavier and more expensive. The invention makes it possible to overcome this difficulty the expansion of the walls of the container during the heat treatment making it possible to prevent the pressure rise in the container. The expansion of the walls of the container is illustrated by the height variation 7. The thermal expansion of the walls of the container generally takes place along the height and along the circumference. Preferably, the expansion of the container is such that it compensates for the variations in volume of the product 5 and of the gas 9. The relative pressure in the container remains substantially constant and close to zero.

FIG. 7 illustrates the container and its contents after cooling to low temperature, said low temperature possibly being ambient temperature. In general, the final temperature after cooling is equivalent to the initial temperature before the heat treatment. On cooling, the product 5 and the gas 9 contract. The container 1 according to the invention also contracts, this contraction being illustrated by the height variation 10. Generally, the value of the contraction 10 of the container is identical to the value of the expansion 7. The second embodiment of the invention is particularly advantageous, since thin-walled containers may be used. The inventors found that a container having a linear thermal expansion coefficient greater than 0.00016 m/(m.K) makes it possible to limit the pressure during the heat treatment; and that a coefficient greater than 0.00020 m/(m.K) is particularly advantageous.

The container according to the invention is characterized by thermal expansion and contraction properties. It has been found that the walls of the container must have a linear thermal expansion coefficient greater than 0.00014 m/(m.K) and preferably greater than 0.00018 m/(m.K). Few materials used for producing containers make it possible to obtain the aforementioned properties. The inventors found that containers made of LDPE were particularly advantageous due to their expansion properties. Containers obtained with certain grades of low-crystallinity PP make it possible to obtain sufficient expansions, said grades of PP preferably being copolymers. It has been observed that a biaxially-oriented container does not have a high thermal expansion coefficient. Similarly, a container formed from a high-crystallinity polymer has a low thermal expansion coefficient.

The invention makes it possible to produce containers of wide variety; the container may be produced by extrusion-blow moulding, by injection moulding, by tubular extrusion, or else by assembling from films. The containers may be bottles or flasks produced by extrusion-blow moulding, pots or beakers produced by moulding, flexible pouches produced by welding from films. The process for manufacturing the container may have an influence on the expansion coefficient of the container. This is because it is known that the extrusion processes orient, more or less markedly, the polymer chains. The orientation of the chains may create an anisotropy of the properties that is expressed by expansion coefficients which differ depending on the direction of measurement. In order to simplify the summary of the invention, an average linear expansion coefficient that is identical in all directions is considered.

Large differences in thermal expansion have also been observed which are linked to the conversion process used to manufacture the container. It would appear that the more the conversion process orients the polymer chains, the lower the thermal expansion of the container manufactured.

The thermal expansion coefficient of the container may be measured according to two methods. A first method consists in measuring the volumetric expansion coefficient of the container by measuring the variation in volume of the container when the temperature changes. A second method consists in measuring the linear expansion coefficient in two perpendicular directions by taking two strips of long length and of narrow width in said directions and by measuring the variation in length of said strips when the temperature changes. When the container is manufactured from a film, it is easy to measure the linear expansion coefficients of said film in two directions.

Figure 8:
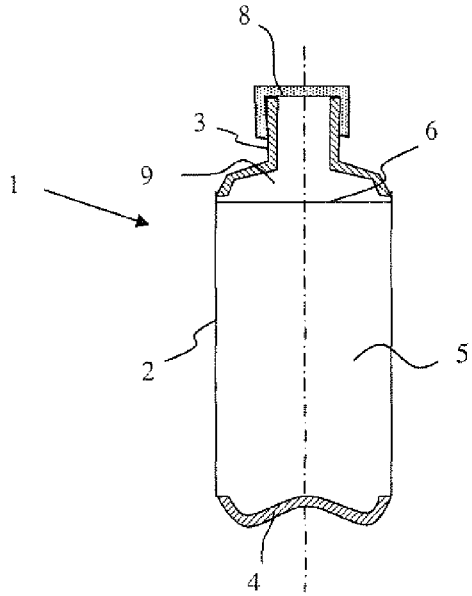

One exemplary embodiment of the container is illustrated in FIG. 8. This container 1 comprises a tubular body 2 joined by welding to a neck 3 and a base 4. A cap 8 fits onto the neck 3 and allows the container to be hermetically sealed. The tubular body 2 forming the side walls may be extruded or formed from a film, the ends of which are joined by welding. The film may be a single-layer or multilayer film. The film does not comprise a layer that is rigid and has a low expansion coefficient such as an aluminium layer or a biaxially-oriented polymer layer. It is observed that a thin layer of a polymer having a barrier property may be inserted into the multilayer structure. An LDPE film containing a thin EVOH layer has thermal expansion properties greater than 0.00018 m/(m.K). It has been found that the multilayer film may contain layers having a low thermal expansion coefficient, if said layers are thin and do not block the expansion of said film. Said film must contain at least 70% of a polymer having a linear thermal expansion coefficient greater than 0.00014 m/(m.K) and preferably greater than 0.00018 m/(m.K). For a multilayer film based on PE and on EVOH, the thickness of the EVOH layer must be less than 10% of the total thickness. If the thickness of the film is 300 microns, the thickness of the EVOH layer is less than 30 microns, and preferably less than 20 microns. The neck and the base provide the container with rigidity and strength and are composed of partially rigid elements of greater wall thickness. Such a container expands and contracts together with the product during the temperature variation due to its side wall. The dimensions of the neck and of the base only vary slightly with temperature.

The invention is not limited to the aforementioned examples relating to materials having an expansion coefficient greater than 0.00014 m/(m.K), said materials possibly being obtained by blending polymers, by polymerization, by compounding or by any other technique known to a person skilled in the art. The blending of polyolefins, the addition of elastomers, the production of polyolefin-based alloys make it possible to adjust the expansion coefficient of the container to that of the contained product. The multilayer structures also make it possible to modify the expansion properties of the walls of the container to those of the contained product.

The invention claimed is:

1. Process of hot-filling a plastic container with a liquid or viscous product;

said process comprising:

filling the container, which comprises a side wall connected by welding to a neck and to a base, with a product at high temperature, hermetically sealing the container, cooling the container and the product contained within the container; and wherein the linear thermal expansion coefficient of the container's side wall is greater than 0.00014 m/(m.K), and wherein the container is allowed to expand and shrink at least as much as the product contained within the container when it is subjected to a temperature variation.

2. The process according to claim 1, wherein the container is allowed to expand and shrink more than the product contained within the container.

3. The process according to claim 1, wherein, after cooling the container and the product contained within the container, a pressure is generated in the container which is greater than or equal to zero.

4. A container obtained from the process according to Claim 1.

5. A plastic container for hot-filling a liquid or viscous product, wherein the container comprises a flexible side wall connected by welding to a base and to a neck of the container, wherein the base and the neck are at least partially rigid, wherein the container is free of a compensating panel, wherein the linear thermal expansion coefficient of the container's flexible side wall is greater than 0.00014 m/(m.K), and wherein the flexible side wall comprises at least 70% LDPE.

6. Container according to claim 5, wherein the linear thermal expansion coefficient is greater than 0.00018 m/(m.K).

7. Container according to claim 5, wherein the flexible side wall is formed from a single-layer or multilayer film.

8. Assembly composed of a container according to claim 5 and of a product contained in the container, wherein, in a temperature range between 0 and 100° C., the expansion and shrinkage of the container are at least equal to the expansion and shrinkage of the product.

9. Assembly according to claim 8 that is hermetically sealed, the pressure of which is constant or increases when the temperature decreases and of which the pressure is constant or decreases when the temperature increases.

* * * * *